US007982827B2

(12) United States Patent
Clatanoff et al.

(10) Patent No.: US 7,982,827 B2
(45) Date of Patent: Jul. 19, 2011

(54) SYSTEM AND METHOD FOR DYNAMICALLY ALTERING A COLOR GAMUT

(75) Inventors: Todd Alan Clatanoff, Allen, TX (US); Gregory S. Pettitt, Farmersville, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1077 days.

(21) Appl. No.: 11/638,918

(22) Filed: Dec. 14, 2006

(65) Prior Publication Data

US 2008/0143736 A1 Jun. 19, 2008

(51) Int. Cl.
*G09G 5/10* (2006.01)

(52) U.S. Cl. ..... 349/88; 345/88

(58) Field of Classification Search ..... 345/87, 345/204, 690, 102

See application file for complete search history.

(56) References Cited

U.S. PATENT DOCUMENTS

| | | | | |
|---|---|---|---|---|
| 5,192,946 | A | 3/1993 | Thompson et al. | |
| 7,248,244 | B2 * | 7/2007 | Akiyama | 345/102 |
| 7,518,584 | B2 * | 4/2009 | Heynderickx et al. | 345/88 |
| 2003/0128218 | A1 * | 7/2003 | Struyk | 345/581 |
| 2003/0142275 | A1 | 7/2003 | Yoshida | |
| 2004/0233339 | A1 | 11/2004 | Elliott | |
| 2005/0243100 | A1 | 11/2005 | Childers | |
| 2007/0064008 | A1 * | 3/2007 | Childers | 345/589 |

* cited by examiner

*Primary Examiner* — Stephen G Sherman

(74) *Attorney, Agent, or Firm* — Charles A. Brill; Wade James Brady, III; Frederick J. Telecky, Jr.

(57) ABSTRACT

System and method for dynamically altering a color gamut used in projection display systems. An embodiment comprises determining a dim color from colors used in representing an image, adjusting the dim color to increase an available display time for a non-dim color used to represent the image, adjusting the non-dim color using the available display time, and generating a color sequence based on the adjusted dim color and the adjusted non-dim color. The pixel intensities of a dim color are increased, permitting a shortening of the display time of the dim color. The newly freed display time can be reallocated to all colors to increase the amount of light used to display the image, thereby increasing image brightness or altering color point.

17 Claims, 5 Drawing Sheets

SYSTEM AND METHOD FOR DYNAMICALLY ALTERING A COLOR GAMUT

TECHNICAL FIELD

The embodiments relate generally to a system and a method for displaying images, and more particularly to a system and a method for dynamically altering a color gamut used in projection display systems.

BACKGROUND

Sequential color display systems, such as display systems utilizing digital micromirror devices (DMDs), deformable micromirrors, transmissive and reflective liquid crystal, liquid crystal on silicon, and so forth, microdisplays, typically time-multiplex different colors across a given video/graphics frame. Each color of light can be modulated by the microdisplay and then displayed onto a display plane. The human eye can integrate the modulated color sequences that are displayed on the display plane into an image.

A traditional sequential color display system, such as a single chip DMD-based projection display system, can use a color filter to produce a color sequence from a wideband light source, such as an electric arc lamp. A common prior art color filter used in single chip DMD-based projection displays systems is a rotating color wheel containing a number of color segments, with the duration of each color in the color sequence being dependent on the size of the respective color segment. An example of a projection display system with a color wheel is described in U.S. Pat. No. 5,192,946, entitled "Digitized Color Video Display System," granted Mar. 9, 1993, which U.S. Patent is incorporated herein by reference. The duration that a particular color is being generated can also be referred to as the display duration. Generally, because the display duration of a color in the color sequence is dependent on the size of the respective color segment, the display duration of the color is fixed.

It is possible to change the display duration of a color in the color sequence by changing the speed of rotation of the color wheel. For example, to shorten the display duration of a color, the color wheel can be rotated at a faster rate, while to lengthen the display duration of a color, the color wheel can be rotated at a slower rate. However, changing the speed of rotation changes the display duration for all colors and individual color display durations cannot be changed without similarly affecting the display duration of other colors. Furthermore, since the color wheel is a physical device, the ordering of the colors in the color sequence is also fixed.

SUMMARY OF THE INVENTION

These and other problems are generally solved or circumvented, and technical advantages are generally achieved, by embodiments of the present invention which provide a system and a method for dynamically altering a color gamut used in projection display systems.

In accordance with an embodiment, a method for displaying an image represented in a multi-color color space is provided. The method includes determining a dim color from the colors representing the image, adjusting the dim color to increase an available display time for a non-dim color used to represent the image, adjusting the non-dim color using the available display time, and generating a color sequence based on the adjusted dim color and the adjusted non-dim color.

In accordance with an embodiment, a method for displaying an image is provided. The method includes adjusting the image in response to a determining that the image contains a dim color, sequentially displaying colors in a color sequence, and loading image data from the image into a spatial modulator. The color sequence is based on the adjusted image. The spatial modulator modulates the displayed color and the image data being loaded corresponds to a color being displayed.

In accordance with an embodiment, a display system is provided. The display system includes a light source, an array of light modulators optically coupled to the light source, and a controller coupled to the array of light modulators and to the light source. The array of light modulators modulates light from the light source based upon image data to produce images on a display plane. The controller includes a dynamic gamut unit coupled to a front end unit, and a sequence selection unit coupled to the dynamic gamut unit and to the light source. The dynamic gamut unit increases image brightness of images provided by the front end unit by adjusting a display duration and a light intensity of colors in images with a dim color, while the sequence selection unit selects a color sequence corresponding to images with adjusted display durations and pixel intensities.

An advantage of an embodiment is the ability to boost the overall color brightness for all colors being displayed. Increased image brightness can improve image quality and increase viewer satisfaction as well as increase the usability of the display system over a larger range of operating environments.

A further advantage of an embodiment is that little additional hardware and software investment is needed to implement the embodiment. Therefore, it is possible to improve image quality with a small development and cost investment. This can help speed the acceptance of the embodiment among developers of display systems.

Yet another advantage of an embodiment is that it is possible to place additional emphasis on special images, such as logos and splash screens, by significantly boosting their brightness. This can help to make the display and the display systems stand out in a sales environment.

A further advantage of an embodiment is that the durations of the colors in the color sequence can be individually changed to meet changing image displaying needs. For example, if the image being displayed is predominantly a single color (or a few colors), it is possible to increase the overall brightness of the displayed image by reallocating the display time currently assigned to colors not used in the image to the colors that are used.

Another advantage of an embodiment is that it is possible to change the color point of the images being displayed, for example, to meet different display environments or user display settings.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The embodiments will be described in a specific context, namely a single-chip DMD-based projection display system. The embodiments may also be applied, however, to other microdisplay-based projection display systems that use sequential colors, such as projection display systems utilizing deformable micromirrors, transmissive and reflective liquid crystal, liquid crystal on silicon, and so forth, microdisplays.

Figure 1:
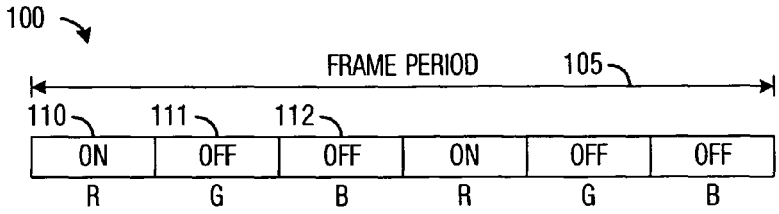
FIG. 1 is a diagram of an exemplary color sequence.

As shown in FIG. 1, an exemplary color sequence 100 for a single frame period 105 is shown. The color sequence 100 includes two red, green, and blue (RGB) color cycles, with a first color cycle comprising a display duration 110 during which a red color is produced by a color filter, a display duration 111 for a green color, and a display duration 112 for a blue color. For example, if in a particular image only the red color is used, when the color filter is producing the green and the blue colors (the duration 111 and the duration 112), none of the colored light is being displayed on the display plane.

Figure 2A:
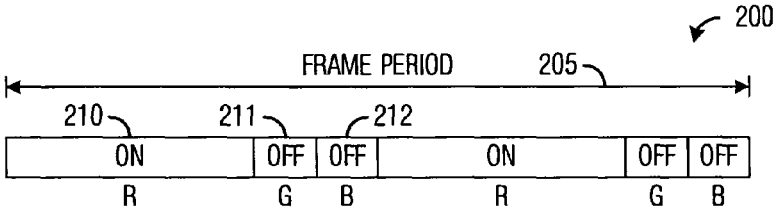
FIGS. 2*a* and 2*b* are diagrams of color sequences with individually modifiable display durations.

With reference now to FIG. 2*a*, there is shown a diagram illustrating an exemplary color sequence 200 for a single frame period 205, wherein the display durations of the individual colors can be modified. As in the color sequence 100, the color sequence 200 includes two RGB color cycles. However, the display durations of the colors can be individually controlled. As shown in FIG. 2*a*, a display duration 210 for the color red can be substantially longer than the display durations for the colors green and blue (display duration 211 and display duration 212, respectively). The second RGB color cycle, as shown in FIG. 2*a*, can be a duplicate of the first RGB color cycle, although the second RGB color cycle can be different from the first RGB color cycle.

The extended display duration of the duration 210 for the color red can result in an increased amount of red in the displayed image. Since the frame period 205 may be required to remain constant, the extension of the display duration 210 can be achieved by shortening the display duration 211 and/or the display duration 212. As shown in FIG. 2*a*, the display duration 211 and the display duration 212 were both shortened to ensure that the overall duration of the two RGB color cycles remain substantially equal to the frame period 205. Although the diagram displays the extension of a single color's display duration within the color cycle, it is possible to extend the display duration of more than one color's display duration within a color cycle up to a limit of N−1 colors, where N is the number of colors in the color cycle. Additionally, the diagram displays the shortening of the display duration of two colors, however, it is possible to shorten the display duration of only a single color.

The discussion provided herein will focus on a three-color projection display system that utilizes the colors red, green, and blue. However, the embodiments can apply to a projection display system that makes use of more than one color, for example, a two-color, other three-color, four-color, five-color, six-color, seven-color, and so forth projection display systems. Therefore, the discussion of a three-color RGB projection display system should not be construed as being limiting to either the scope or the spirit of the present invention.

Figure 2B:
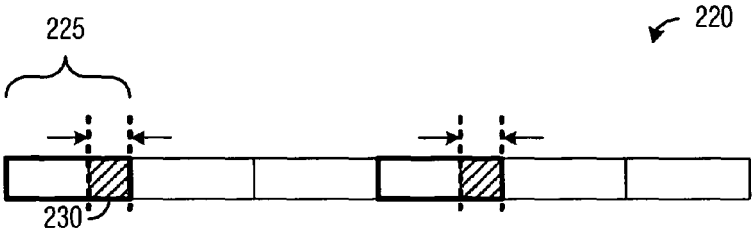

With reference now to FIG. 2*b*, there is shown a diagram illustrating an exemplary color sequence 220. In addition to changing the display duration of a color within a color sequence to change the amount of light of the color displayed on the display plane, it can also be possible to change the intensity of the color displayed on the display plane. For example, while maintaining a fixed display duration for a color, it is possible to increase the amount of light of the color by increasing the intensity (brightness) of the color.

In addition to increasing the amount of light of the color displayed on the display plane, increasing the intensity of the colored light can be used to enable the shortening of the display duration for the colored light while effectively displaying the same amount of light. The color sequence 220 shows a display duration 225 for displaying a color. However, the light being produced during the display duration 225 may not be at maximum intensity. Therefore, the maximum amount of light for the color is not being produced. For example, if during the display duration 225, the light being produced is at 80% of full intensity, then the amount of light produced during the display duration 225 is only 80% of maximum. Therefore, if the intensity of the light being produced can be boosted up to 100% of full intensity, then the light may not need to be produced for the entirety of the display duration 225. If the intensity of the light is boosted up to 100% of full intensity, then only 80% of the display duration 225 is needed. The remaining 20% of the display duration (shown as interval 230) may be reallocated to increase the brightness of the other colors displayed during their respective display durations. The reallocation of the interval 230 can be made to one or more of the other colors in the color sequence 220 or to all colors in the color sequence 220.

Figure 3:
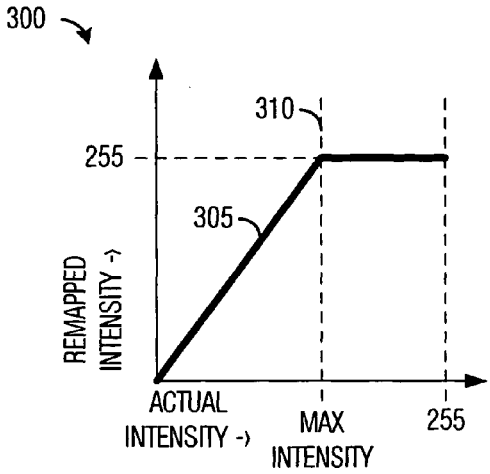
FIG. 3 is a diagram of a relationship between actual pixel intensity and remapped pixel intensity.

With reference now to FIG. 3, there is shown a diagram illustrating a relationship 300 between actual pixel intensity and remapped pixel intensity for an exemplary color. As shown in FIG. 3, data shown in the diagram corresponds to 8-bit data, but the resolution and precision of the data is arbitrary. A light source producing a color can typically have a maximum pixel output limit and may not be able to produce any additional light or may be able to do so with significantly reduced life span. A trace 305 illustrates a relationship between actual pixel intensity and remapped pixel intensity of an exemplary color.

For a certain range of actual pixel intensities, there may be a direct relationship between the actual pixel intensity and the remapped pixel intensity. The diagram shown in FIG. 3 displays a piece-wise linear relationship between the actual pixel intensity and the remapped pixel intensity, however, the relationship between the actual pixel intensity and the remapped pixel intensity for a particular color can differ based on the image content.

The actual pixel intensity can increase with increasing remapped pixel intensity until the remapped pixel intensity reaches a point of maximum intensity (shown in FIG. 3 as label 'MAX INTENSITY' and as a dashed vertical line 310). At the point of maximum intensity, the color has been determined to have no pixel values above this maximum value, which in turn can be used for determining the color's maximum brightness. The process for determining this maximum value may treat values above the maximum as if they were the maximum, and as the actual pixel intensity increases beyond the point of maximum intensity, the remapped pixel intensity remains flat.

Therefore, if a displayable color in a projection display system has pixel intensity values that are less than its maximum value, it can be possible to increase the output pixel intensities for the color so that a display duration for the light can be shortened and reallocated to increase the brightness of the colors in the color sequence.

Figure 4A:
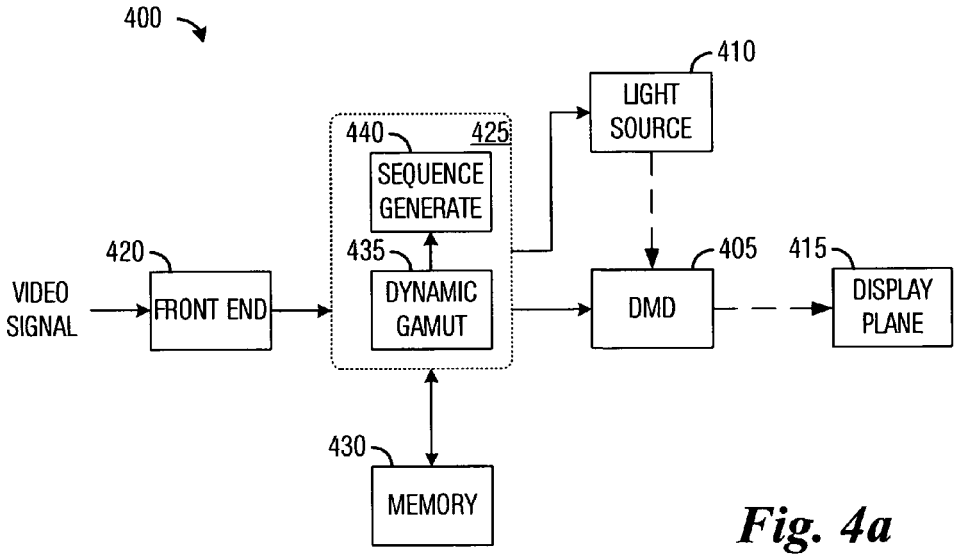
FIGS. 4*a* and 4*b* are diagrams of an exemplary projection display system and a detailed view of a controller of the projection display system.

With reference now to FIG. 4*a*, there is shown a diagram illustrating a high level view of a sequential color projection display system 400, wherein the projection display system 400 dynamically adjusts a color gamut by altering color intensities and display durations. The projection display system 400 utilizes a spatial light modulator, more specifically, an array of light modulators 405, wherein individual light modulators in the array of light modulators 405 assume a state corresponding to image data for an image being displayed by the projection display system 400. The array of light modulators 405 is preferably a digital micromirror device (DMD) with each light modulator being a positional micromirror. For example, in display systems where the light modulators in the array of light modulators 405 are micromirror light modulators, then light from a light source 410 can be reflected away from or towards a display plane 415. A combination of the reflected light from all of the light modulators in the array of light modulators 405 produces an image corresponding to the image data. The projection display system 400 can be a single-chip DMD-based projection display system 400, wherein a single DMD can be used to display every color used in the projection display system.

A front end unit 420 can perform operations such as converting analog input signals into digital, Y/C separation, automatic chroma control, automatic color killer, and so forth, on an input video signal. The front end unit 420 can then provide the processed video signal, which can contain image data from images to be displayed to a controller 425. The controller 425 can be an application specific integrated circuit (ASIC), a general purpose processor, and so forth, and can be used to control the general operation of the projection display system 400. In additional to controlling the operation of the projection display system 400, the controller 425 can be used to process the signals provided by the front end unit 420 to help improve image quality. For example, the controller 425 can be used to perform color correction, adjust image bit-depth, color space conversion, and so forth. A memory 430 can be used to store image data, sequence color data, and various other information used in the displaying of images.

The controller 425 can include a dynamic gamut unit 435 that can be used to adjust the color gamut of the projection display system 400 by adjusting the brightness of the colors being produced by the light source 410 as well as the display durations of the colors. The dynamic gamut unit 435 can improve overall image quality of the projection display system 400 by increasing the brightness of the images being displayed by the projection display system 400. A detailed description of the dynamic gamut unit 435 is provided below.

The controller 425 can also include a sequence generate unit 440 that can be used to generate (or select) color sequences to produce and display the colors as adjusted by the dynamic gamut unit 435. For example, the sequence generate unit 440 can receive a description of the color sequence (or the actual color sequence itself) and create light control commands that can be provided to the light source 410. The light control commands can be directly provided to the light source 410 that can produce the desired colors or the light control commands can be provided to a light driver unit that can convert the light control commands into control commands and/or drive currents that can be provided to the light source 410.

Figure 4B:
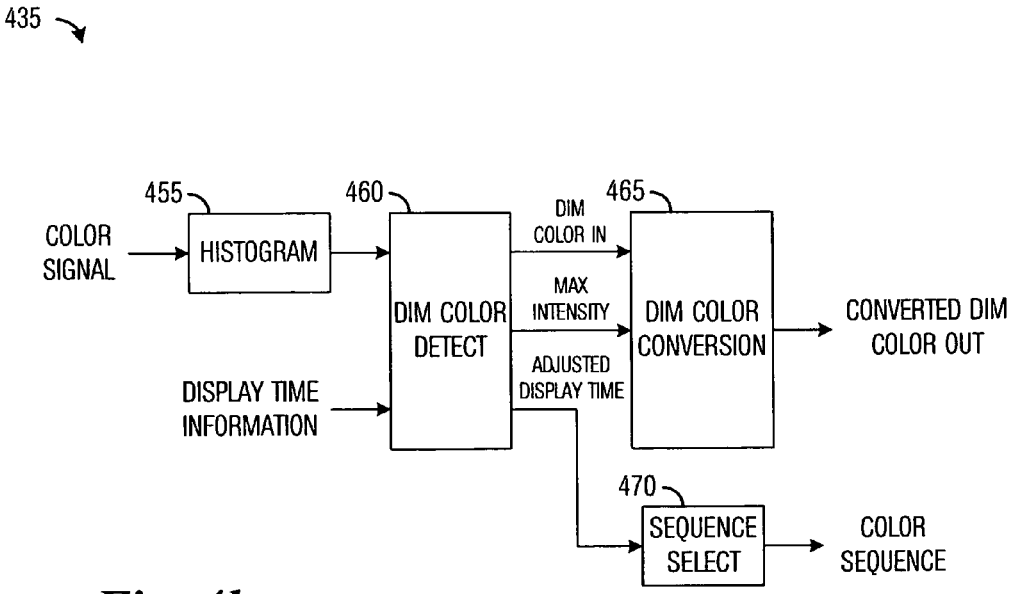

With reference now to FIG. 4*b*, there is shown a diagram illustrating a detailed view of the dynamic gamut unit 435. As discussed previously, the dynamic gamut unit 435 can receive color signal information as input and make adjustments to the color signal information by altering the intensities of one or more colors in a color sequence as well as the display durations of the colors to help increase the brightness of the images being displayed.

Figure 5:
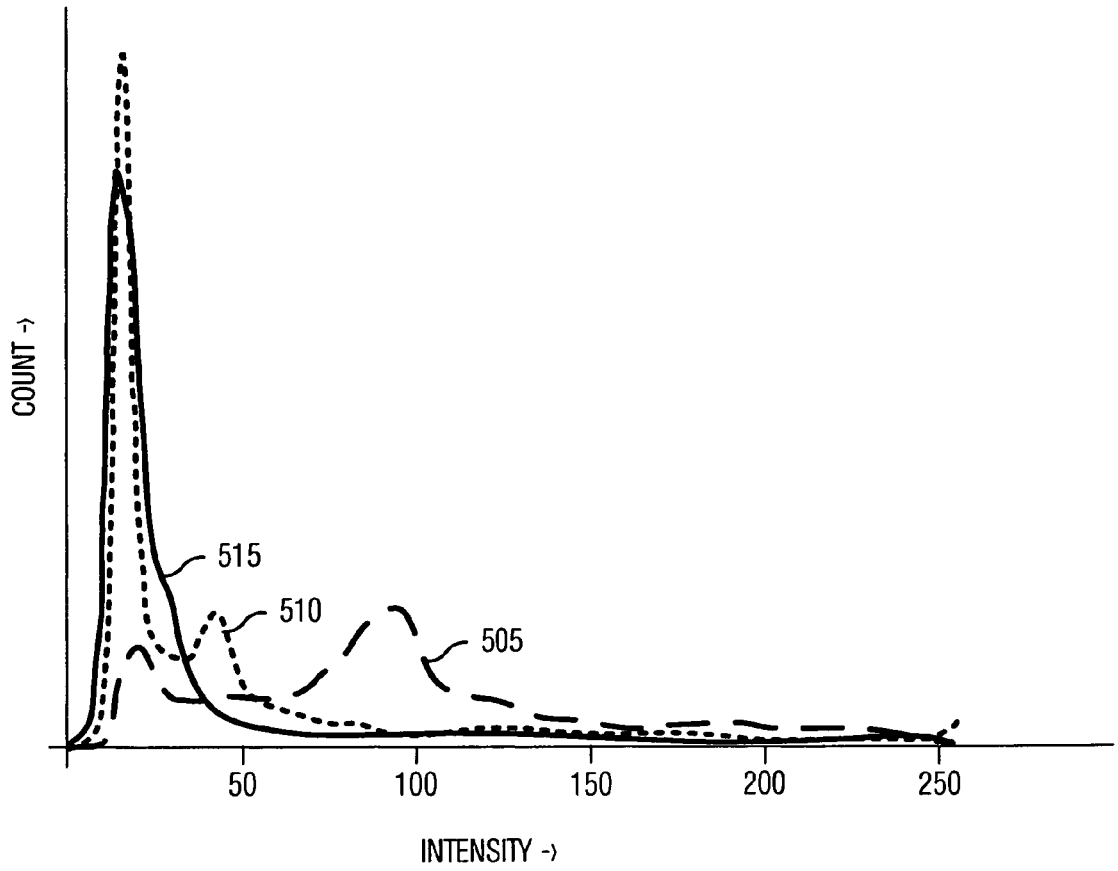
FIG. 5 is a diagram of histograms of colors in an exemplary image.

The dynamic gamut unit 435 can begin with a color input signal, which can contain video frames in a particular color space, such as the RGB color space. The color input signal can be provided to a histogram unit 455. The histogram unit 455 can compute a histogram of the color input signal on a frame-by-frame basis. The histogram unit 455 can preferably compute a histogram for each color of the color space. For example, if the color input signal is in the RGB color space, then the histogram unit 455 can compute histograms for the R, the G, and the B colors, respectively. A histogram can include a count of the number of picture elements present in a frame of the color input signal at a given intensity. For example, with an exemplary picture, there may be 29 picture elements with the color R at intensity 9. Therefore, for the color R's histogram, there will be a data point at (intensity=9, count=29). FIG. 5 illustrates histograms for an exemplary frame from a color input signal. A first curve 505 displays histogram information for the color R, a second curve 510 displays histogram information for the color G, and a third curve 515 displays histogram information for the color B.

The histograms for the multiple colors can then be provided to a dim color detect unit 460. The dim color detect unit 460 can determine if any of the colors are dim colors by determining a highest non-zero intensity for each color and comparing it against a specified threshold. If, for a given color, the highest non-zero intensity is less than a specified threshold, then the color can be classified as a dim color. This threshold can be used to determine the highest intensity for which the accumulated histogram count above this highest intensity just exceed the threshold value. For example, referencing back to the histograms shown in FIG. 5, using a zero threshold of 0.2%, the highest non-zero intensity for the colors are 193 for the color R (shown in FIG. 5 as the first curve 505), 255 for the color G (shown in FIG. 5 as the second curve 510), and 54 for the color B (shown in FIG. 5 as the third curve 515), respectively.

Other zero threshold values can be used. If the zero threshold is smaller than 0.2%, for example, 0.1%, then the highest non-zero intensity may be at a higher intensity value. While, if the zero threshold is larger than 0.2%, for example, 0.5%, then the highest non-zero intensity may be at a lower intensity value. With a smaller zero threshold value, then few colors may be selected as dim colors, while more colors may be selected as dim colors if the zero threshold value is larger. For this example, the total number of pixels for the color B intensity values from 55 to 255 represent 0.2% (or less) of the total intensity values in the video/graphics frame. With such a low highest non-zero intensity, the color B may be selected as a dim color. Although in the example, only one color (color B) is selected as a dim color, more than one color within a single frame may be selected as dim colors.

It may be possible to use a percentage value or a number value for the specified threshold. For example, as a percentage value, the specified threshold can be set at 75 percent of the maximum intensity, which in a situation with a maximum intensity of 255 is approximately 191. Alternatively, as a number value, the specified threshold can be set at 191, which in a situation with a maximum intensity of 255 is the 75 percent value.

In addition to the histogram information from the histogram unit 455, the dim color detect unit 460 can also be provided duty cycle information for the colors in the color sequence that will be used to display the image in the frame. The duty cycle can also be referred to as a normalized display duration. For example, in a three color RGB projection display system with equal duty cycles for each color, the duty cycle information can be R=0.3333, G=0.3333, and B=0.3333. Alternatively, if the display duration for the color R is twice as long as the display durations for the colors G and B, then the duty cycle information can be R=0.5000, G=0.2500, and B=0.2500. The duty cycle information can be used by the dynamic gamut unit 435 to make adjustments to the intensity and the display duration of the dim color(s) and the other colors in the projection display system.

The selected dim color(s) (if any of the colors are selected as dim colors) can be provided to a dim color conversion unit 465. In addition to the selected dim color(s), maximum intensity information for each selected dim color(s) can also be provided. The maximum intensity information can be used to build the transfer function that maps actual pixel intensities to modified pixel intensities for use with a compressed duty cycle.

The dim color conversion unit 465 can boost the intensity of the selected dim color(s) using the maximum intensity information to the color's maximum pixel output limit. Referring back to FIG. 3, the dim color conversion unit 465 can push the desired pixel intensity to the point of maximum intensity. The dim color conversion unit 465 can provide, as output, the converted (adjusted) dim color, which can then be provided to the sequence generate unit 440 (FIG. 4*a*) to be used to create light commands for the light source 410. Alternatively, there may be a practical limit placed on the adjustments that can be made to either the intensity of the dim color or the dim color's display duration or both. If such limits are reached, then the dim color conversion unit 465 may not need to boost the intensity of the selected dim color to its maximum pixel output limit, but just to a level that will result in the practical limits taking effect.

The dim color detect unit 460 can also be coupled to a sequence selection unit 470. The dim color detect unit 460 can provide to the sequence selection unit 470 the adjusted display durations of the colors in the color sequence. The sequence select unit 470 can then select from multiple color sequences stored in a memory a color sequence that most closely matches the adjusted display durations as provided by the dim color detect unit 460. However, unless there happens to be a very good match, there can be display duration errors with this technique.

Alternatively, the sequence create unit 470 can use a technique referred to as clock dropping and a reference color sequence to generate a color sequence that is a very close match to the adjusted display times. In an embodiment of the clock dropping technique, a reference color sequence that specifies a minimum duration (or a nominal duration) for each color in color sequence that is based on the reference color sequence may be used to create a color sequence that is a very close match to the adjusted display times. Cycles of a reference clock used to time the generation of a color for display purposes may be skipped (or added) in a ratio substantially equal to a ratio of a duration of the color in the reference color sequence and an adjusted display time of the color. The skipping of the cycles may enable a lengthening (or shortening) of the color in the reference color sequence until its display time is substantially equal to that of the adjusted display time. A detailed discussion of the use of clock dropping and a reference color sequence to generate a color sequence with any desired display duration can be found in a co-assigned patent application entitled "System and Method for Color-specific Sequence Scaling for Sequential Color Systems," Ser. No. 11/545,436, filed Oct. 10, 2006, which patent application is incorporated herein by reference.

The color sequence, either selected from sequences stored in a memory or generated using the clock dropping technique in conjunction with reference sequences, can then be used to affect the color sequence by the light source 410. As the light source 410 sequentially produces the colors in the color sequence, the controller 425 can load image data corresponding to the color being produced into the DMD 405 and then instruct the light modulators in the DMD 405 to assume positions based on the image data. The colored light, as modulated by the DMD 405, can reflect onto the display plane 415, where the user's eye can integrate the light into an image.

If the image is represented mostly by a single color, for example, an image that is mostly a single color, then the display duration that is allocated to the other colors can be reallocated to the display of the single color. The reallocation of almost the entire color cycle to the display of a single color can result in an increase in brightness of the image by a significant margin (on the order of 20 to 200 percent). In an exemplary image that is purely yellow and is being displayed by a seven-color projection display system (RGBCYMW, for instance), the display duration allocated for the color yellow (Y) can be approximately $3/7^{th}$ (since the color Y can be formed from colors R+G and Y) of the available display time. However, since the image is purely yellow, the display duration allocations for the other four colors (B, W, C, M) are not needed and can be reallocated to the display of the color yellow. Therefore, there can be more than a two-fold (7/3) increase in the display duration of the color yellow, hence the image can be significantly brighter. The boosting can occur with any color in the color sequence, such as with a primary color (R, G, or B) or with a secondary color (C, Y, or M) or combinations thereof.

As an example of an image (or images) that can be good candidates for brightness boosting are images that are corporate logos and/or images used for splash screens. These images tend to have a small number of colors. With these types of images, there is typically a desire to maximize the brightness. Increased brightness can help to set the images displayed by the projection display system and, hence, the projection display system, apart from images displayed by other projection display systems. The small number of colors used in these images can lend themselves to the bright boosting technique of the embodiments.

Figure 6:
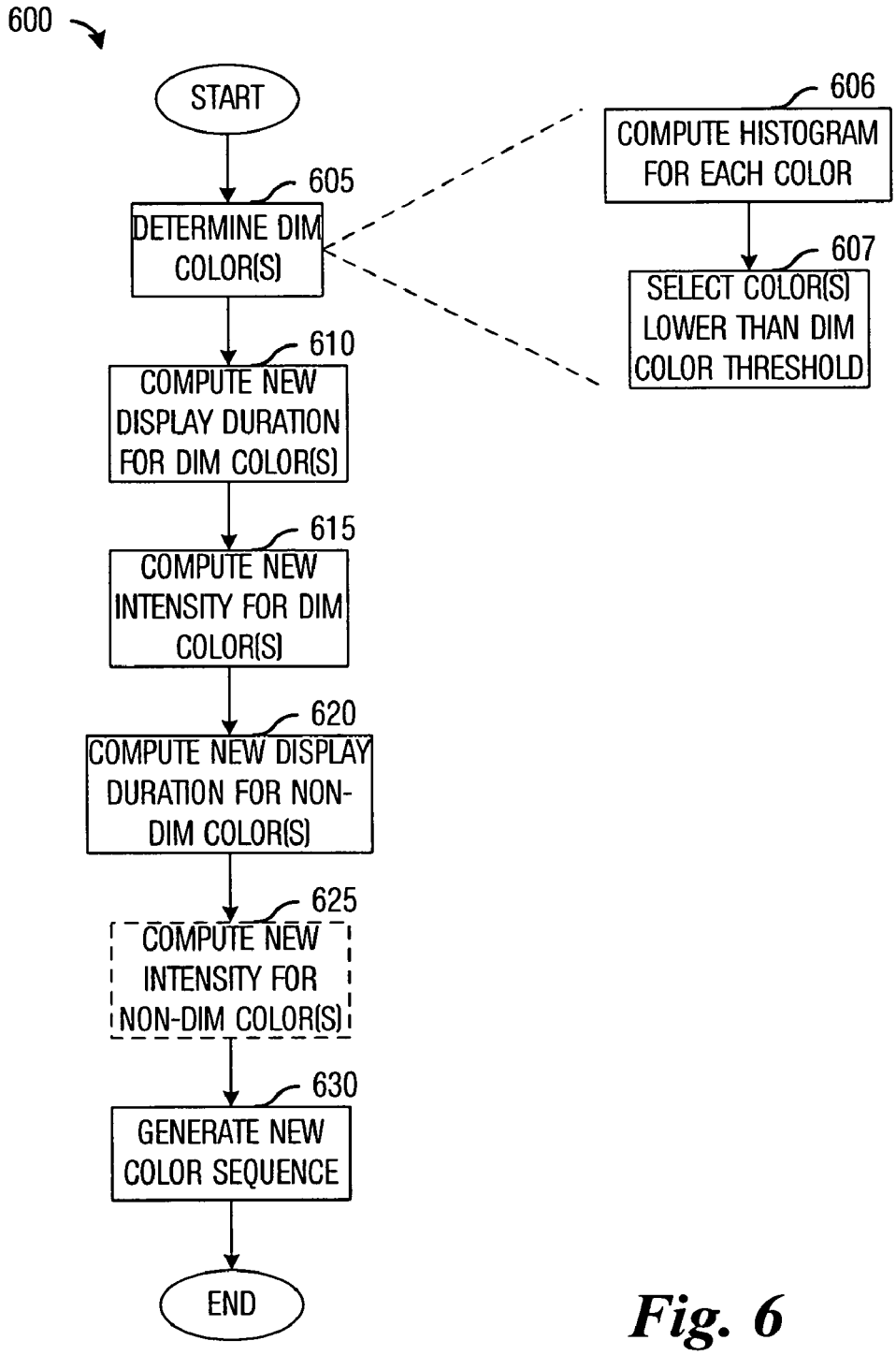
FIG. 6 is a diagram of a sequence of events in the adjusting of the display duration and intensity of a dim color.

With reference now to FIG. 6, there is shown a diagram illustrating a sequence of events 600 in the adjusting of the display duration and intensity of a dim color(s) to increase image brightness in a projection display system. In some embodiments, the sequence may be performed in a different order, or some of the steps may be performed at the same time. The increasing of an image's brightness can begin with a determination of the presence of a dim color(s) (block 605). For an image (or a frame of an image), there may be one or more dim colors and the determination of an image's dim color(s) can begin with a computation of a histogram for each color of the image's color space (block 606). Each color's histogram can then be processed to determine if the color can be classified as a dim color. For example, the classification of a color being a dim color can be accomplished by comparing the color's maximum non-zero intensity with a dim color threshold, with the color being classified as a dim color if its maximum non-zero intensity is less than the dim color threshold (block 607).

With the dim color(s) selected (block 607), a computation of new display durations for the dim color(s) can proceed (block 610). According to an embodiment, the computation of a new display duration can involve a computation of a display duration that is needed to provide an equivalent (or substantially) equivalent amount of light to the amount of light produced, with a light source providing the dim color adjusted so that it will produce light at its maximum light output limit. This can then be followed with a computation of a new light intensity for the dim color(s) (block 615). The pixel intensities can be boosted using the color's maximum pixel output limit. However, there can be a limit placed on the amount of intensity boosting that can be applied to a dim color, since too much intensity boosting can cause portions of the image to become saturated and image detail can be lost.

After the computation of the new display duration and pixel intensity remapping for the dim color(s) (blocks 610 and 615), it is possible to compute new display durations for the non-dim colors (block 620). The new display durations for the non-dim colors can make use of newly freed display times from the computation of the new display durations for the dim color(s) (block 610). However, the available display times cannot simply be allocated to the non-dim colors since the simple reallocation can result in a shift in the white point (or secondary color points) of the image being displayed. A detailed description of an exemplary technique for allocating the available display times while preserving the white point is provided below. After computing the new display durations for the non-dim colors (block 620), an optional computation for new light intensities for the non-dim colors can be performed (block 625). By increasing the duty cycles of the non-dim colors, the image brightness can be further increased. Again, the computations generally should be performed with a consideration for maintaining the image white point (or secondary color points).

After the new display duration and the new pixel intensities for the dim color(s) and the new display duration and, optionally, the new light intensity for the non-dim colors have been computed, it is necessary to determine the color sequence that can be used to command the light source to produce the colors and intensities (block 630). As discussed previously, a new color sequence can be selected from a set of color sequences stored in a memory. The selected sequence can be selected so that it will have a color sequence with the least display duration and intensity differences with respect to the newly computed display durations and intensities. Alternatively, the clock dropping technique can be used in conjunction with reference color sequences to create a color sequence that may be substantially equal to the new color sequence. The generated color sequence can then be provided to the light source.

Figure 7A:
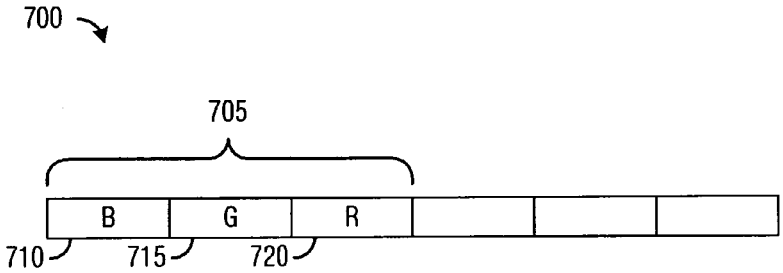
FIGS. 7*a* through 7*d* are diagrams of durations and duty cycles for an exemplary color sequence as the colors in the color sequence are adjusted.
Figure 7B:
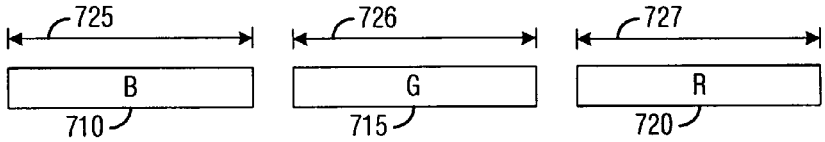

With reference now to FIGS. 7*a* through 7*d*, there are shown diagrams illustrating display durations and duty cycles for an exemplary color sequence 700 as colors in the color sequence 700 are adjusted to improve image brightness. A diagram shown in FIG. 7*a* illustrates the color sequence 700 containing two RGB color cycles, such as a first RGB color cycle 705. The first RGB color cycle 705 contains three display durations, one for color R, G, and B, respectively. In a first display duration 710, the color B is produced by a light source, in a second display duration 715, the light source produces the color G, and in a third display duration 720, the color R is produced. Each color is produced by the light source for the entirety of its display duration, and as shown in FIG. 7*a*, the display durations are substantially equal. A diagram shown in FIG. 7*b* provides an expanded view of the display durations of the first color cycle 705. A display duration for a color X can have a duty cycle that is expressible as:

$$\text{duty_cycle}_X = \frac{\text{display_duration_X}}{\text{display_duration_all colors}}.$$

As shown in FIG. 7*b*, a duty cycle 725 of the color B is 0.3333, a duty cycle 726 of the color G is 0.3333, and a duty cycle 727 of the color R is 0.3333.

For discussion purposes, let histograms of the three colors RGB for an exemplary image indicate that for the color R, the maximum non-zero intensity is 193, for the color G, the maximum non-zero intensity is 255, and for the color B, the maximum non-zero intensity is 54, with a maximum intensity for each color set at 255. Hence, the color with the most under utilized duty cycle is the color B (also referred to as the dim color), with a duty cycle utilization of $54/255$=21.18% (rounded to 20%). However, for such an under utilized duty cycle, a practical limit may set the duty cycle utilization to 80% (0.8). Hence, with the duty cycle artificially limited to 80%, the color B has 20% (0.2) of its duty cycle unused.

With each color's original duty cycle being 0.3333 (since the color cycle is evenly distributed between the three colors in the color cycle), a fraction of the dim color's duty cycle that can be reallocated back to itself can be expressed as:

$$= \left| \frac{-(\text{duty_cycle_B})^2 + \text{duty_cycle_B}}{-(\text{duty_cycle_B})^2 - \text{duty_cycle_B} + 2} \right|$$

$$= \left| \frac{-(.8)^2 + .8}{-(.8)^2 - .8 + 2} \right| = \left| \frac{.16}{.56} \right| = 0.2857.$$

The dim color's duty cycle needed to maintain color intensity can be expressed as:

$$= \text{\%_of_duty_cycle_utilization} * \text{dim_color_duty_cycle}$$

$$= (.8) * (0.3333) = 0.2664.$$

Figure 7C:
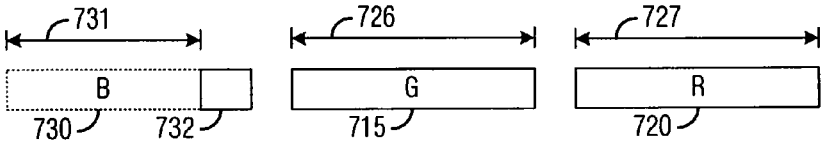

The adjusted dim color's duty cycle is shown in FIG. 7*c* as display duration 730 and duty cycle 731. A difference between the adjusted dim color's display duration 730 and its original display duration is shown as display duration 732, which can be reallocated to each color of the first color cycle 705.

The adjusted dim color's duty cycle can be expressed as:

$$= (\text{dim_color's_duty_cycle_needed_to_maintain_brightness}) + (\text{fraction_of_dim_color's_duty_cycle_reallocated_back_to_self} * \%\text{_of_dim_color's_unused_duty_cycle} * \text{dim_color_duty_cycle})$$

$$= 0.2664 + (0.2857 * 0.2 * 0.3333) = 0.2854.$$

Figure 7D:
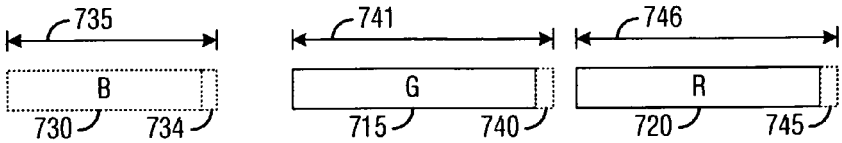

A difference between the dim color's duty cycle needed to maintain color intensity (0.2664) and the adjusted dim color's duty cycle (0.2854) is shown in FIG. 7*d* as display duration 734 with an adjusted overall duty cycle 735.

The resulting changes to the dim color's duty cycle and light intensity can have an effect on the brightness of the dim color. The boost to the dim color's brightness can be expressed as:

$$= \frac{\text{adjusted_dim_color's_duty_cycle}}{\text{dim_color's_duty_cycle}} = \frac{0.2854}{0.2664} = 1.071.$$

Then, the available duty cycle for the non-dim colors can be expressed as:

$$= 1 - \text{adjusted_dim_color's_duty_cycle} = 1 - 0.2854 = 0.7146.$$

Since the duty cycles of the two non-dim colors are equal, the new duty cycle for each non-dim color can be expressed as:

$$= \frac{\text{duty_cycle_non-dim_color}}{\sum \text{duty_cycle_non-dim_colors}} * \text{available_duty_cycle_for_non-dim_colors}$$

$$= 0.3568.$$

The new duty cycle for each non-dim color can be greater than the non-dim color's original duty cycle, with a difference being shown in FIG. 7*d* as display durations 740 and 745 and adjusted overall duty cycles 741 and 746.

The resulting changes to the non-dim colors' duty cycle and light intensity can have an effect on the brightness of the non-dim colors. The boost to the non-dim color's brightness can be expressed as:

$$= \frac{\text{adjusted_non-dim_color's_duty_cycle}}{\text{duty_cycle_non-dim_color}} = 1.071.$$

It should be evident to those of ordinary skill in the art that small modifications to the above equations can be implemented if the duty cycles (and hence, the display durations) of the non-dim colors were not equal. Such modifications are considered to be well understood by those of ordinary skill in the art and will not be discussed herein. Similarly, if more than one color was selected as a dim color, the computation of the adjustments to the duty cycles of the various colors in the color cycle can be repeated for each of the dim colors.

Rather than maintaining the white point of the image, as discussed above, the adjustments to the display durations and duty cycles of the colors (both the dim colors and the non-dim colors) in the color sequence can be made with an intention of purposely adjusting the white point (or another color point of the projection display system) towards a desired position. For example, if the projection display system is operating in an environment that has a specific color cast, which can be detected by an optical sensor in the projection display system or by user input, the adjustments to the display durations and the duty cycles can be made so that the images will have a color point that will result in a good quality image when viewed by the user.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for displaying an image, the method comprising:

determining a dim color from colors used in representing the image;

adjusting the dim color to increase an available display time for a non-dim color used to represent the image, comprising:

computing an adjusted display duration for the dim color comprising a scaling of an original display duration of the dim color, wherein the scaling comprises a specified ratio in response to a determining that a ratio of an original brightness of the dim color to a maximum brightness of the dim color is less than a specified value; and computing an adjusted pixel intensity for the dim color;

adjusting the non-dim color using the available display time; and generating a color sequence based on the adjusted dim color and the adjusted non-dim color.

2. The method of claim 1, wherein the determining comprises:

computing a histogram for each color representing the image; and setting a color to be a dim color based in response to a determining that a maximum non-zero intensity level of the respective histogram is less than a dim color threshold.

3. The method of claim 2, wherein the maximum non-zero intensity level is the largest intensity level with a non-zero count, and wherein a count of less than a specified error level is considered non-zero.

4. The method of claim 1, wherein the adjusted display duration comprises a scaling of an original display duration of the dim color, wherein the scaling comprises a ratio of an original brightness of the dim color to a maximum brightness of the dim color.

5. The method of claim 1, wherein the adjusting of the non-dim color comprises computing a new display duration for the non-dim color.

6. The method of claim 5, wherein the adjusting of the non-dim color further comprises computing a new light intensity for the dim color.

7. The method of claim 1, wherein the generating comprises selecting the color sequence from a list of color sequences.

8. The method of claim 1, wherein the generating comprises creating the color sequence from a reference color sequence and dropping clock cycles from a reference clock.

9. The method of claim 1, wherein the adjusting of the dim color and the adjusting of the non-dim color are restricted to maintaining a white point or a secondary point of the image.

10. A method for displaying an image, the method comprising:

adjusting the image in response to a determining that the image contains a dim color, comprising:

adjusting the dim color to increase an available display time for a non-dim color used to represent the image, comprising:

computing an adjusted display duration for the dim color comprising a scaling of an original display duration of the dim color, wherein the scaling comprises a specified ratio in response to a determining that a ratio of an original brightness of the dim color to a maximum brightness of the dim color is less than a specified value; and computing an adjusted pixel intensity for the dim color;

sequentially displaying colors in a color sequence, wherein the color sequence is based on the adjusted image; and loading image data from the image into a spatial modulator, wherein the spatial modulator modulates the displayed color, wherein the image data being loaded corresponds to a color being displayed.

11. The method of claim 10, wherein the adjusting comprises:

adjusting the dim color to increase an available display time for a non-dim color used to represent the image; and adjusting the non-dim color using the available display time.

12. The method of claim 10, wherein the adjusting of the dim color and the adjusting of the non-dim color are restricted so that the displayed image has a desired color point.

13. The method of claim 10, wherein the loading is repeated for each color in the color sequence and for all image data from the image.

14. A display system comprising:

a light source;

an array of light modulators optically coupled to the light source, the array of light modulators configured to modulate light from the light source based upon image data to produce images on a display plane;

a controller coupled to the array of light modulators and to the light source, the controller comprising a dynamic gamut unit coupled to a front end unit, the dynamic gamut unit configured to increase image brightness of images provided by the front end unit by adjusting a display duration and a light intensity of colors in images with a dim color, wherein the dynamic gamut unit comprises:

a histogram unit coupled to the front end unit, the histogram unit configured to create a histogram for each color used in the image provided by the front end unit, wherein a histogram comprises picture element counts at various intensities of a single color;

a dim color detect unit coupled to the histogram unit, the dim color detect unit configured to designate a dim color in response to the determining that a maximum non-zero intensity for a color is less than a dim color threshold and to adjust a display time for the dim color; and a dim color convert unit coupled to the dim color detect unit, the dim color convert unit configured to adjust a pixel intensity for the dim color; and a sequence selection unit coupled to the dynamic gamut unit and to the light source, the sequence selection unit configured to select a color sequence corresponding to images with adjusted display durations and pixel intensities.

15. The display system of claim 14, wherein the dim color detect unit is further configured to adjust a display time for non-dim colors, wherein non-dim colors are colors in the image not designated a dim color.

16. The display system of claim 14, wherein the sequence generate unit generates the color sequence by dropping clock cycles of a reference clock and using a reference sequence.

17. The display system of claim 14, wherein the array of light modulators is a digital micromirror device (DMD).

* * * * *